US007146758B1

(12) United States Patent
Gaston

(10) Patent No.: US 7,146,758 B1
(45) Date of Patent: Dec. 12, 2006

(54) SIGN INDICATING STATUS OF OCCUPANT OF CUBICLE OR OFFICE AND METHOD OF USE

(76) Inventor: Nancy Lindblad Gaston, 6315 Drill Field Ct., Centreville, VA (US) 20121-2311

( * ) Notice: Subject to any disclaimer, the term of this patent is extended or adjusted under 35 U.S.C. 154(b) by 267 days.

(21) Appl. No.: 10/833,044

(22) Filed: Apr. 28, 2004

Related U.S. Application Data

(60) Provisional application No. 60/481,109, filed on Jul. 19, 2003.

(51) Int. Cl.
*G09F 11/00* (2006.01)

(52) U.S. Cl. ..... 40/490; 40/491; 40/907

(58) Field of Classification Search ..... 40/490, 40/491, 488, 907, 407
See application file for complete search history.

(56) References Cited

U.S. PATENT DOCUMENTS

| | | | | | |
|---|---|---|---|---|---|
| 143,804 | A | * | 10/1873 | Boyle | 434/419 |
| 276,191 | A | * | 4/1883 | Mendum | 40/490 |
| 477,417 | A | | 6/1892 | Howard | |
| 588,254 | A | * | 8/1897 | Walker | 40/491 |
| 854,971 | A | * | 5/1907 | Thomas | 40/338 |
| 885,760 | A | | 4/1908 | Jones | |
| 919,816 | A | | 4/1909 | Bryan | |
| 1,101,826 | A | * | 6/1914 | Woolums | 116/324 |
| 1,418,144 | A | | 5/1922 | Fetters | |
| 1,672,389 | A | * | 6/1928 | Mahon | 40/491 |
| 2,509,059 | A | | 5/1950 | Hirschhorn | |
| 3,604,133 | A | * | 9/1971 | Hawa | 40/491 |
| 3,797,150 | A | | 3/1974 | Hinckley | |
| 3,883,967 | A | | 5/1975 | Barnes | |
| 4,138,787 | A | | 2/1979 | Sarkisian et al. | |
| 4,530,177 | A | | 7/1985 | Kane | |
| 4,679,341 | A | * | 7/1987 | Goldman | 40/611.06 |
| 5,257,472 | A | | 11/1993 | Harnois et al. | |
| D351,423 | S | * | 10/1994 | Cassidy, Jr. | D20/18 |
| 6,003,258 | A | | 12/1999 | Godfrey et al. | |
| 6,076,295 | A | | 6/2000 | Garfinkle | |
| 6,108,955 | A | | 8/2000 | Folsom et al. | |
| 6,374,523 | B1 | | 4/2002 | Smith | |

FOREIGN PATENT DOCUMENTS

| | | |
|---|---|---|
| FR | 2 677 788 | 12/1992 |
| GB | 2 167 590 | 5/1986 |

* cited by examiner

*Primary Examiner*—Cassandra Davis
(74) *Attorney, Agent, or Firm*—Stephen Christopher Swift; Swift Law Office

(57) ABSTRACT

A sign for workplaces and a method for its use. The preferred embodiment comprises a rectangular board retained by extendable brackets on the wall of a cubicle or the door of an office. Alternatively, the board may be retained on a wall, door or other surface by strips of hook and loop fasteners, glue, nails, screws, or any other suitable means. The board preferably has three sections or windows. The top and middle sections have front slots for retaining a choice of several rectangular message cards that can be slid in or out of the slots. The bottom section is an erasable white board on which messages can be written. Unused message cards may be stored in rear slots in each section, where they can be identified by their tabs that extend beyond a side of the board. Indicia may be included on the board such as trademarks or names.

14 Claims, 13 Drawing Sheets

SIGN INDICATING STATUS OF OCCUPANT OF CUBICLE OR OFFICE AND METHOD OF USE

CROSS REFERENCE TO RELATED APPLICATION

This application is based on Provisional Patent Application Ser. No. 60/481,109, filed Jul. 19, 2003.

BACKGROUND OF THE INVENTION

1. Field of the Invention

The present invention relates to signage and methods of using the signage.

2. Description of the Prior Art

There have been numerous prior inventions of signage, but none that are equivalent to the present invention.

U.S. Pat. No. 477,417, issued on Jun. 21, 1892, to Frank P. Howard, discloses a sign supported by a chain, with several rectangular sections in which letters can be removably retained. The sections are connected by short chains. The instant invention is distinguishable, in that its sections are parts of a single piece.

U.S. Pat. No. 885,760, issued on Apr. 28, 1908, to Willard Jones, discloses a rectangular door plate, in which letters can be removably retained in a single slot. The instant invention is distinguishable, in that it has a plurality of slots in which messages can be retained.

U.S. Pat. No. 919,816, issued on Apr. 27, 1909, to Joseph P. Bryan, discloses another changeable letter sign supported by a chain, having two separate sections connected by rods. Again, the instant invention is distinguishable, in that its sections are parts of a single piece.

U.S. Pat. No. 1,418,144, issued on May 30, 1922, to Charles A. Fetters, discloses a reversible sign supported by a string, with several rectangular sections connected by U-shaped clamping members. The instant invention is distinguishable, in that its sections are parts of a single piece, and its sections have slots in which messages can be retained.

U.S. Pat. No. 2,509,059, issued on May 23, 1950, to Hilmer Hirschhorn, discloses a changeable display device, supported by a string, with several sections connected by flexible tapes. Again, the instant invention is distinguishable, in that its sections are parts of a single piece, and its sections have slots in which messages can be retained.

U.S. Pat. No. 3,797,150, issued on Mar. 19, 1974, to Sandrajeanne Bushell Hinckley, discloses a hanging display apparatus with several pockets in which cards being displayed may be retained. The instant invention is distinguishable, in that it has pockets in which message cards not currently being displayed may be stored.

U.S. Pat. No. 3,883,967, issued on May 20, 1975, to Guy W. Barnes, discloses a sign with changeable character plates. Again, the instant invention is distinguishable, in that it has pockets in which message cards not currently being displayed may be stored.

U.S. Pat. No. 4,138,787, issued on Feb. 13, 1979, to Robert Sarkisian and David U. Hillstrom, discloses a display holder with several track members for gripping and holding differently sized posters, signs and advertising materials. The instant invention is distinguishable, in that it has pockets in which message cards not currently being displayed may be stored.

U.S. Pat. No. 4,530,177, issued on Jul. 23, 1985, to Michael Kane, discloses a sign with interchangeable characters. The instant invention is distinguishable, in that it has pockets in which message cards not currently being displayed may be stored.

U.S. Pat. No. 5,257,472, issued on Nov. 2, 1993, to Yves Harnois and André Bareil, discloses a sign board having a container for holding a stack of display sheets, with the foremost display sheet being visible through a window. The instant invention is distinguishable, in that in its pockets in which message cards not currently being displayed may be stored, the cards are not visible through a window, but are identified by tabs extending outside the pockets.

U.S. Pat. No. 6,003,258, issued on Dec. 21, 1999, to Don Godfrey and Amal Godfrey, discloses an adjustable display panel, with strips displaying messages that may be slid into and out of portions of the panel. The instant invention is distinguishable, in that it has pockets in which message cards not currently being displayed may be stored.

U.S. Pat. No. 6,076,295, issued on Jun. 20, 2000, to Benjamin L. Garfinkle, discloses a modular sign system, with parallel rails for retaining signs in signage slots between separator slots. The instant invention is distinguishable, in that it has pockets in which message cards not currently being displayed may be stored.

U.S. Pat. No. 6,108,955, issued on Aug. 29, 2000, to Lonnie K. Folsom and Glenn A. Maskiw, discloses a sign for displaying changeable messages, including a planar blackboard with a plurality of tracks. The instant invention is distinguishable, in that it has pockets in which message cards not currently being displayed may be stored.

U.S. Pat. No. 6,374,523, issued on Apr. 23, 2002, to Richard Smith, discloses a holder for mounting to a surface, such as a door, and interchangeably displaying a sheet of material. The instant invention is distinguishable, in that it has a plurality of sections in which different types of messages can be displayed.

British Patent Application No. GB 2 167 590 A, published on May 29, 1986, inventor Richard Kenneth Elms, discloses a display frame for holding a card or sheet. The instant invention is distinguishable, in that it has a plurality of sections in which different types of messages can be displayed.

French Patent Application No. FR 2 677 788 A1, published on Dec. 18, 1992, inventor Pacaux Bruno, discloses a panel for displaying information on cards retained on the panel. The instant invention is distinguishable, in that in has pockets in which message cards not currently being displayed may be stored, in which the cards are identified by tabs extending outside the pockets.

None of the above inventions and patents, taken either singly or in combination, is seen to describe the instant invention.

SUMMARY OF THE INVENTION

The invention is a sign for workplaces and a method for its use. The preferred embodiment comprises a rectangular board retained by extendable brackets on the wall of a cubicle or the door of an office. The board preferably has three sections. The top and middle sections have slots and frames for retaining and displaying a choice of several rectangular signs that can be slid in or out of the slots. The bottom section is preferably an erasable white board on which messages can be written. A felt-tipped marker or other writing instrument may be retained in a holder above the top section.

Accordingly, it is a principal object of the invention to provide an apparatus by which an occupant of a work enclosure can silently communicate his or her availability.

It is another object of the invention to provide an apparatus by which an occupant of a work enclosure can silently communicate his or her lack of availability and the reasons therefor.

It is a further object of the invention to provide a method of communicating availability using the aforementioned apparatus.

Still another object of the invention is to provide a method of communicating lack of availability using the aforementioned apparatus.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
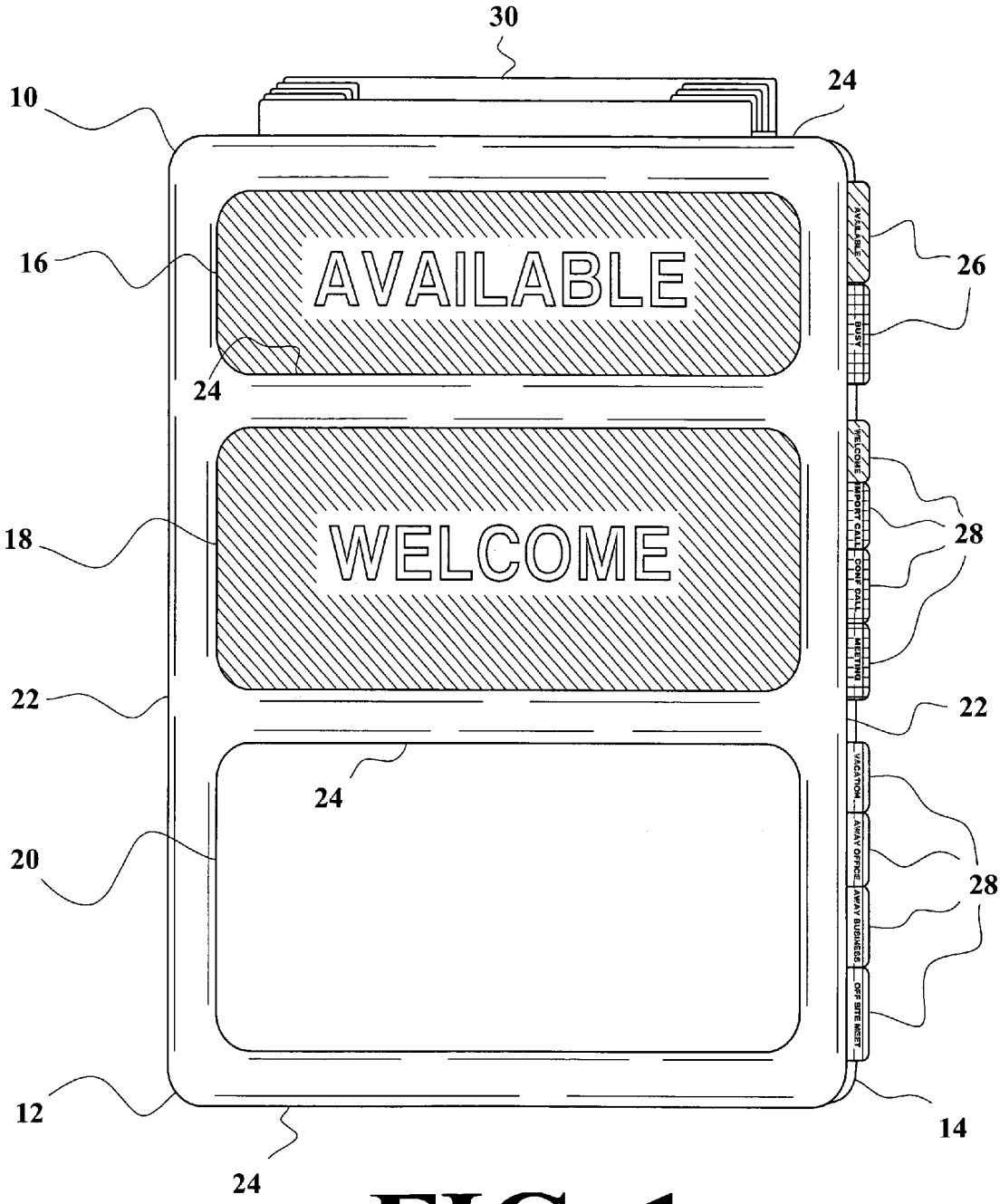
FIG. 1 is a perspective view of the preferred embodiment of the invention.
Figure 2:
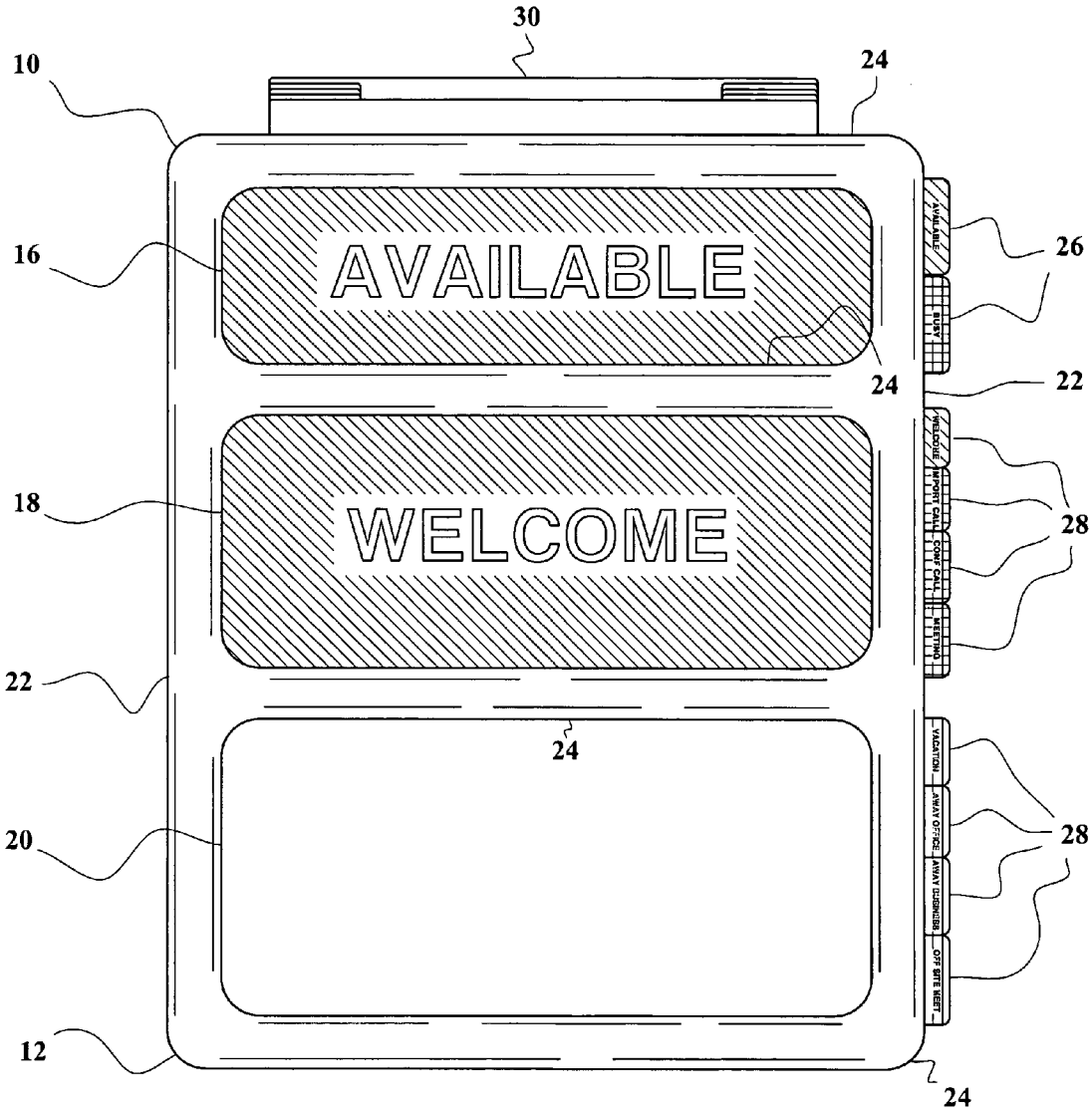
FIG. 2 is a front elevational view of the preferred embodiment of the invention.

FIG. 1 is a perspective view of the preferred embodiment of the invention 10, showing its front frame 12 and back panel 14, both of which are rectangular with rounded corners. The preferred embodiment has three sections or windows: a top section 16, a middle section, 18, and a bottom section 20. Vertical members 22 and horizontal members 24 of the front frame surround and separate the front of each section. Smaller message cards 26 may be inserted into the top section, and larger message cards 28 may be inserted into the middle section. The bottom section has an erasable writing surface, such as a white board, so that additional information can be provided. A felt-tipped marker or other suitable writing implement may be stored in holder 30. Optionally, an eraser may also be stored in the holder. FIG. 2 is a front elevational view of the preferred embodiment of the invention.

Figure 3:
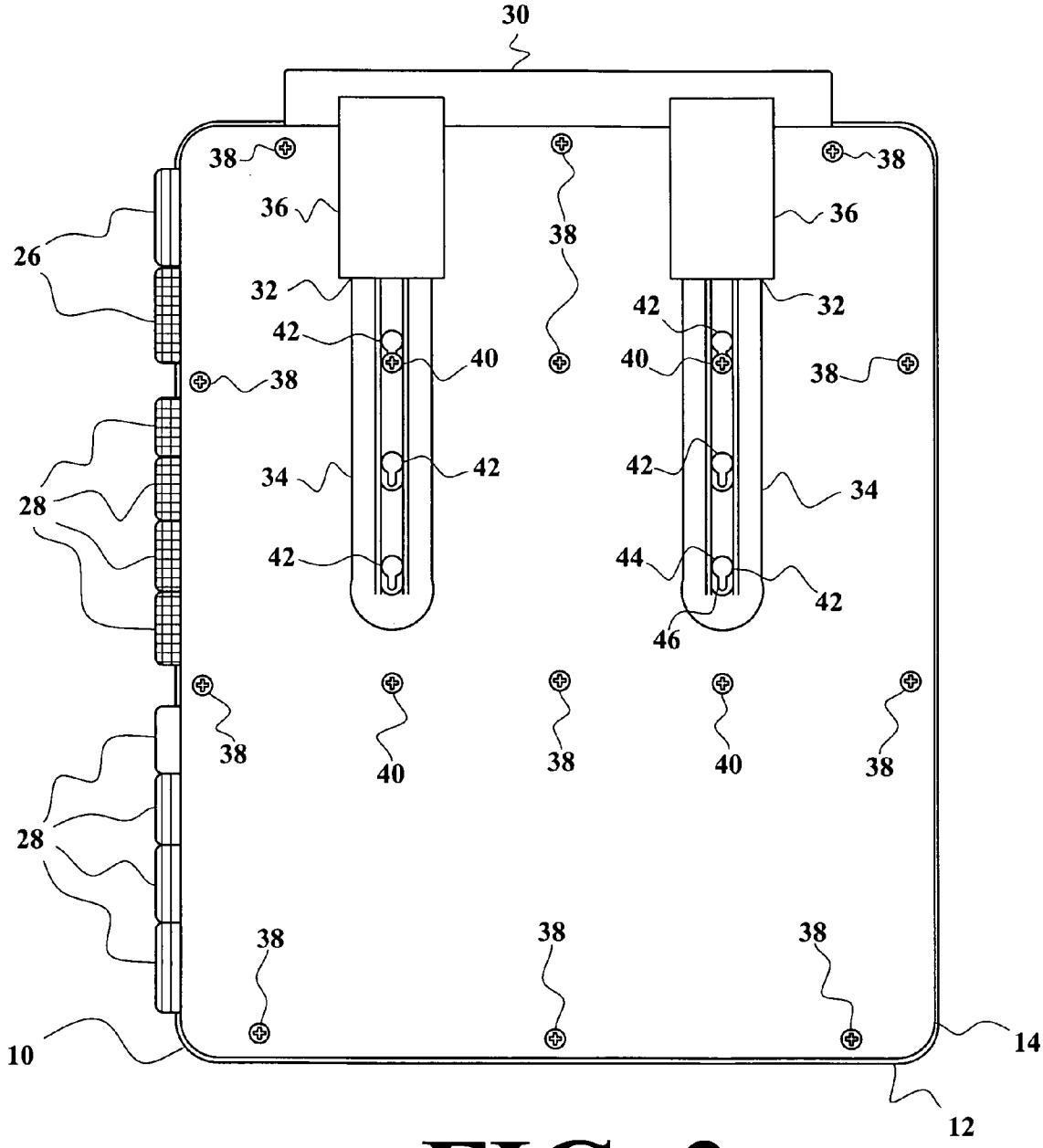
FIG. 3 is a rear elevational view of the preferred embodiment of the invention.

FIG. 3 is a rear elevational view of the preferred embodiment of the invention, showing the brackets 32 by which the invention may be retained on a wall or door. Each bracket has a first section 34 that is attached to the back panel, and second section 36 that goes over the other side of the wall or door. Screws 38 hold the front frame and the rear panel together. Screws 40 retain the brackets on the rear panel. There are several screw holes 42 in the first section of each bracket. The vertical position of the brackets may be adjusted by using different screw holes. It is preferable for the sake of stability that each bracket be retained on the back panel by two screws. (There is a screw hole near the top of the first section each bracket that is not shown in the drawings, because it is behind the second section as shown in FIG. 3.) Each screw holes has a wider upper portion 44 through which the head of a screw (that is already in the back panel) can be inserted, an narrower lower portion 46 into which the shaft of the screw will be drawn by the weight of the invention.

Figure 4:
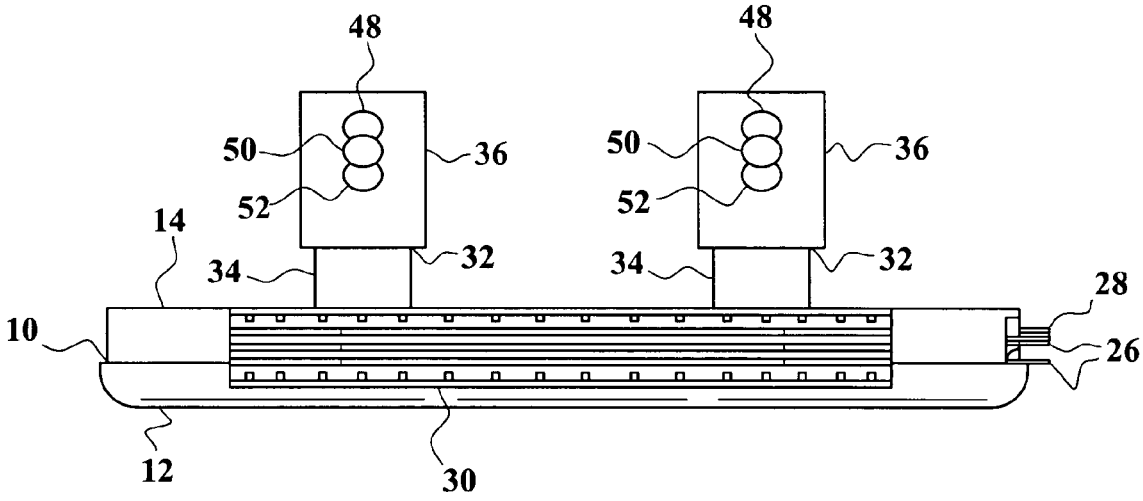
FIG. 4 is a top plan view of the preferred embodiment of the invention.

FIG. 4 is a top plan view of the preferred embodiment of the invention, showing the holes 48 in the tops of the second sections of the brackets. A knob 50 at the end of a tongue 52 extending from the top of the first section of each bracket enables the bracket to be adjusted horizontally and telescopingly to accommodate the thickness of a wall or door. The holes are configured to retain the knobs in a plurality of fixed positions. When a knob and tongue are depressed, the knob can be moved from one position to another in the hole.

Figure 5:
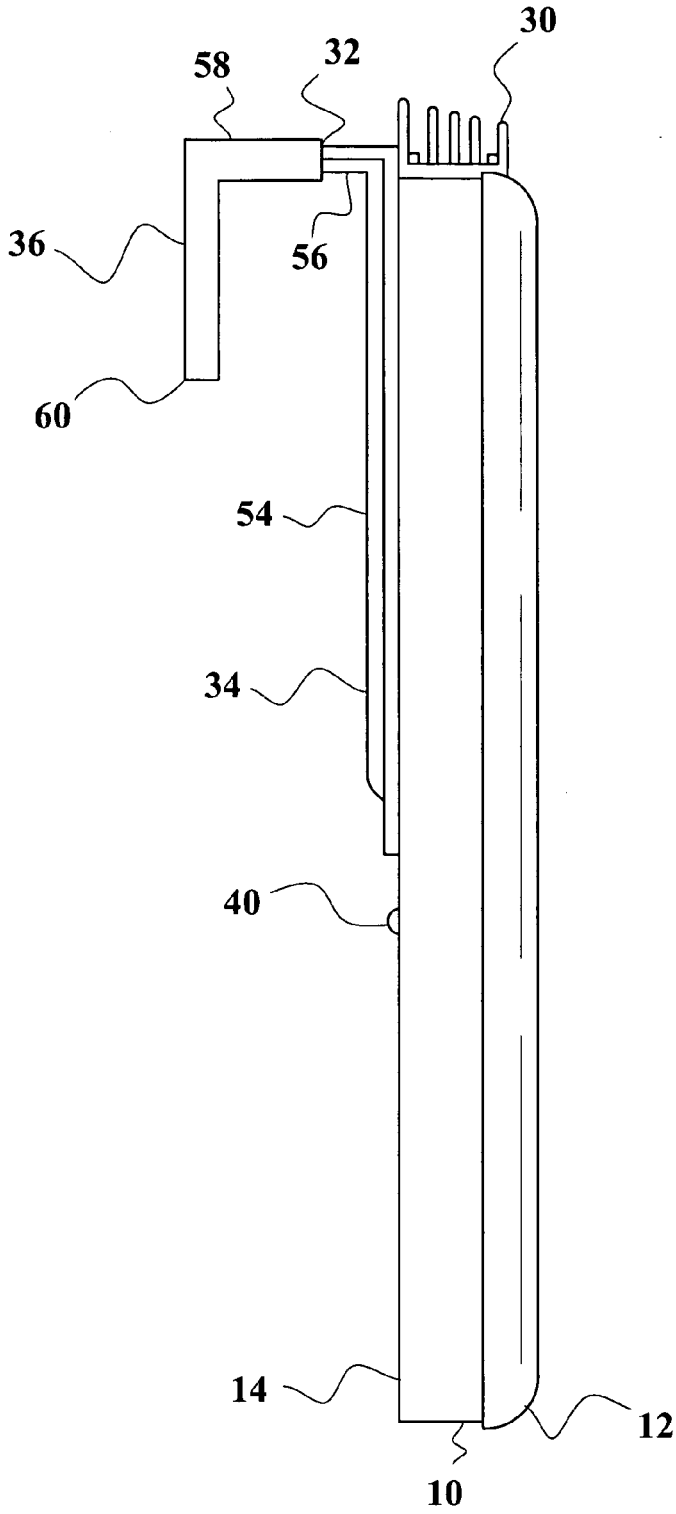
FIG. 5 is a left side elevational view of the preferred embodiment of the invention.

FIG. 5 is a left side elevational view of the preferred embodiment of the invention, showing that each section of the brackets 32 is L-shaped. The first section 34 has a horizontal part 54 and a vertical part 56. The second section 36 likewise has a horizontal part 58 and a vertical part 60. The horizontal and vertical sections are preferably at right angles to each other.

Figure 6:
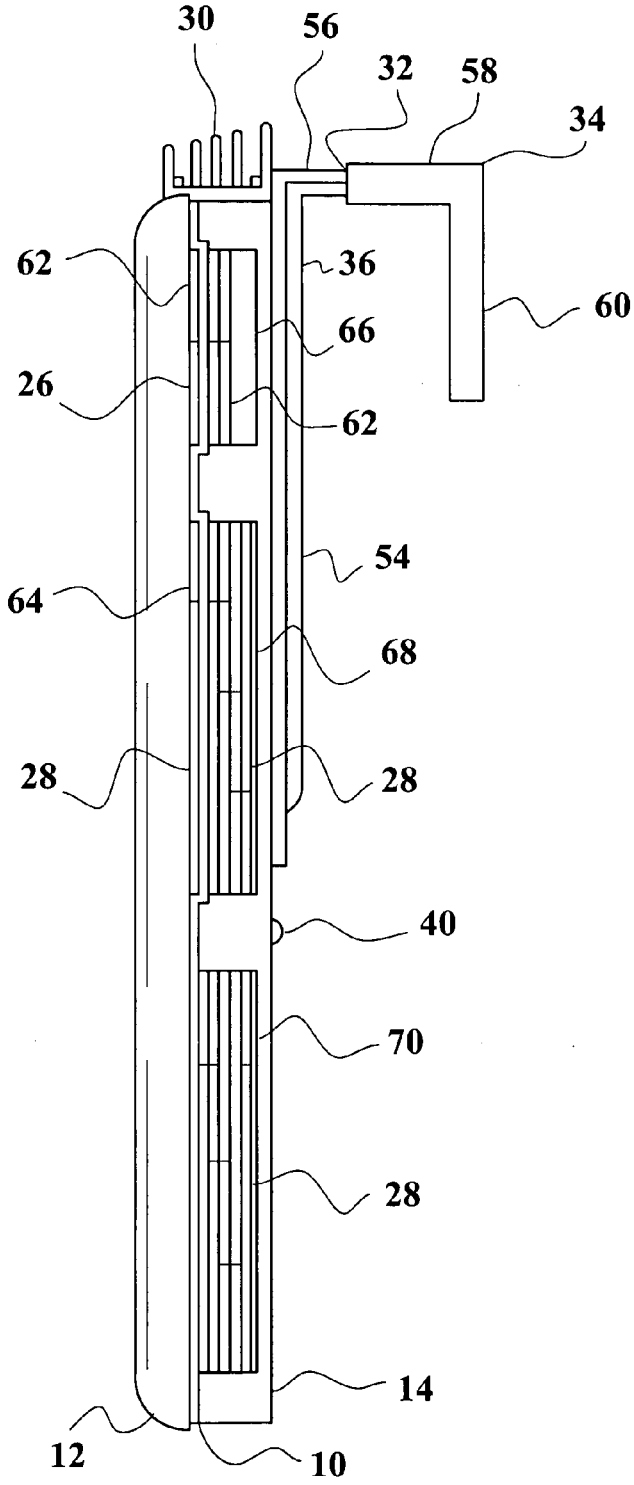
FIG. 6 is a right side elevational view of the preferred embodiment of the invention.

FIG. 6 is a right side elevational view of the preferred embodiment of the invention, showing the slot 62 in the top section in which one of the smaller message cards 26 may be displayed, and the slot 64 in the middle section in which one of the larger message cards 28 may be displayed. The smaller message cards that are not being displayed may be stored in rear slot 66 in the top section. The larger message cards that are not being displayed may be stored in rear slot 68 in the middle section and rear slot 70 in the bottom section.

Figure 7:
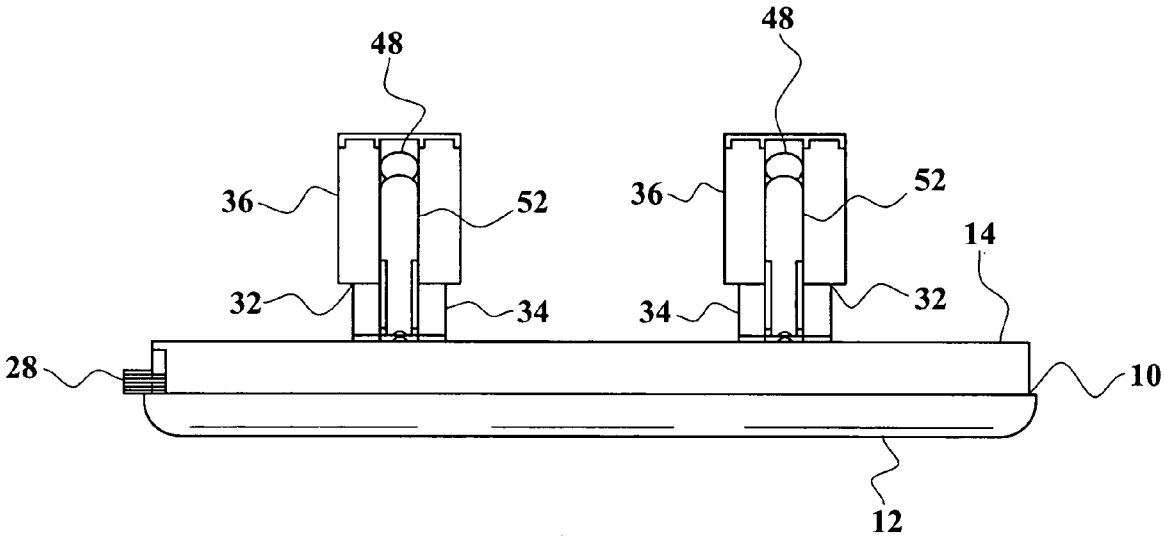
FIG. 7 is a bottom plan view of the preferred embodiment of the invention.

FIG. 7 is a bottom plan view of the preferred embodiment of the invention, showing the tongues 52 extending from the first sections 34 of the brackets 32, with the knobs on their upper surfaces (not visible in FIG. 7) that fit into holes 48 in the second sections 36 of the brackets.

FIGS. 8 through 20 show that message cards that are included in the preferred embodiment of the invention. The cards are color coded, so that a larger card will normally be displayed in the middle section that is the same color as the smaller card displayed in the top section. The colors used are preferably green, yellow and red, the same as the conventional colors of traffic lights. Each card has a main body 72 with a message in large letters for display, and a tab 74 with the same message or an abbreviated version of it in small letters (except for the blank card, as explained below). When a message card is being stored in one of the rear slots, the tab is the only portion of it that is visible. The letters are preferably white on green and red message cards and black on yellow cards. Preferably, the larger and smaller message cards should differ in height, but have the same width.

Figure 8:
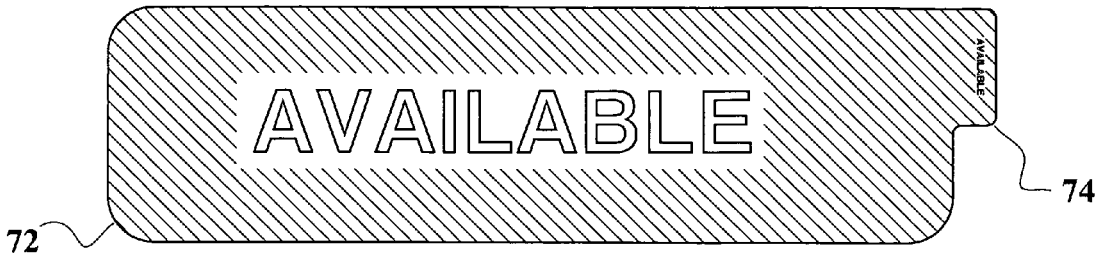
FIG. 8 is a front elevational view of a message card that may be inserted into the upper section of the sign, lined to indicate that its preferred color is green.

FIG. 8 is a front elevational view of a message card that may be inserted into the upper section of the sign, lined to indicate that its preferred color is green. It has the word "AVAILABLE" on both its main body and its tab.

Figure 9:
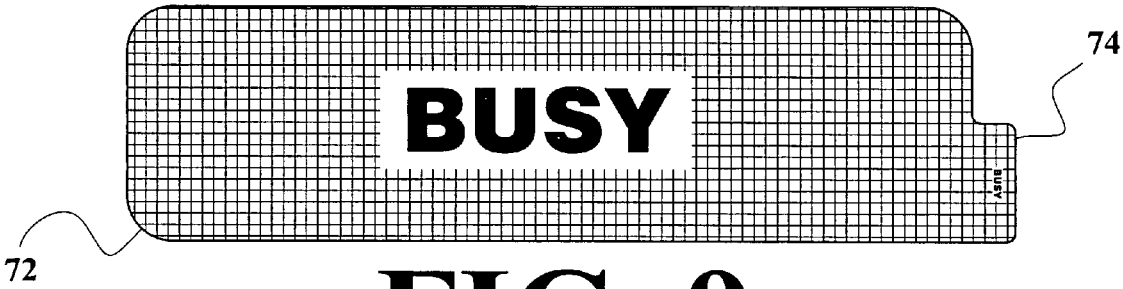
FIG. 9 is a front elevational view of a message card that may be inserted into the upper section of the sign, lined to indicate that its preferred color is yellow.

FIG. 9 is a front elevational view of a message card that may be inserted into the upper section of the sign, lined to indicate that its preferred color is yellow. It has the word "BUSY" on both its main body and its tab.

Figure 10:
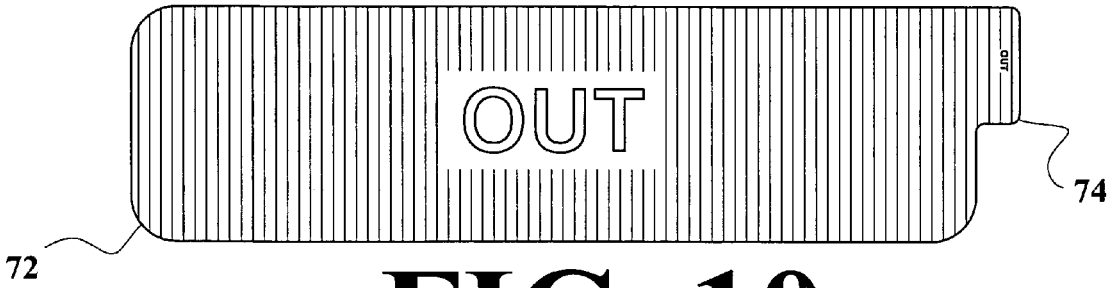
FIG. 10 is a front elevational view of a message card that may be inserted into the upper section of the sign, lined to indicate that its preferred color is red.

FIG. 10 is a front elevational view of a message card that may be inserted into the upper section of the sign, lined to indicate that its preferred color is red. It has the word "OUT" on both its main body and its tab.

Figure 11:
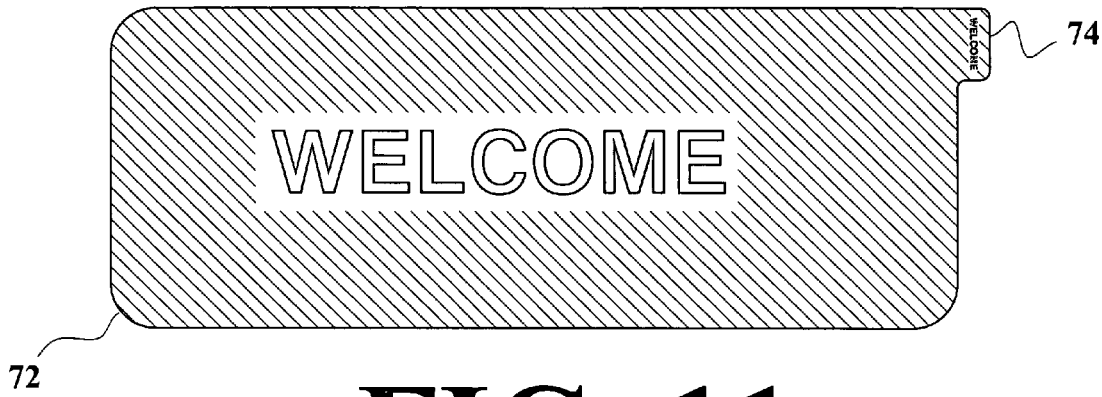
FIG. 11 is a front elevational view of a message card that may be inserted into the middle section of the sign, lined to indicate that its preferred color is green.

FIG. 11 is a front elevational view of a message card that may be inserted into the middle section of the sign, lined to indicate that its preferred color is green. It has the word "WELCOME" on both its main body and its tab.

Figure 12:
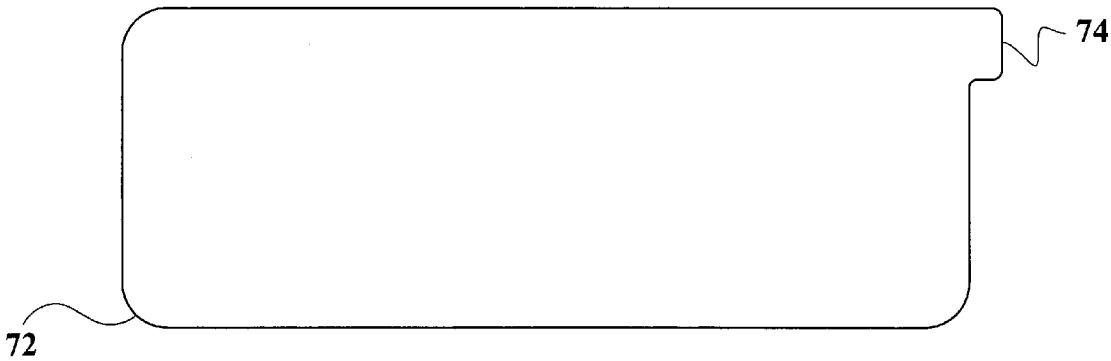
FIG. 12 is a front elevational view of a blank message card that may be inserted into the middle section of the sign.

FIG. 12 is a front elevational view of a blank message card that may be inserted into the middle section of the sign. It has no message on either it main body or its tab. Its color is preferably white. It should preferably have an erasable writing surface on its front surface. It may be used to give a message other than those on one of the other larger message cards.

Figure 13:
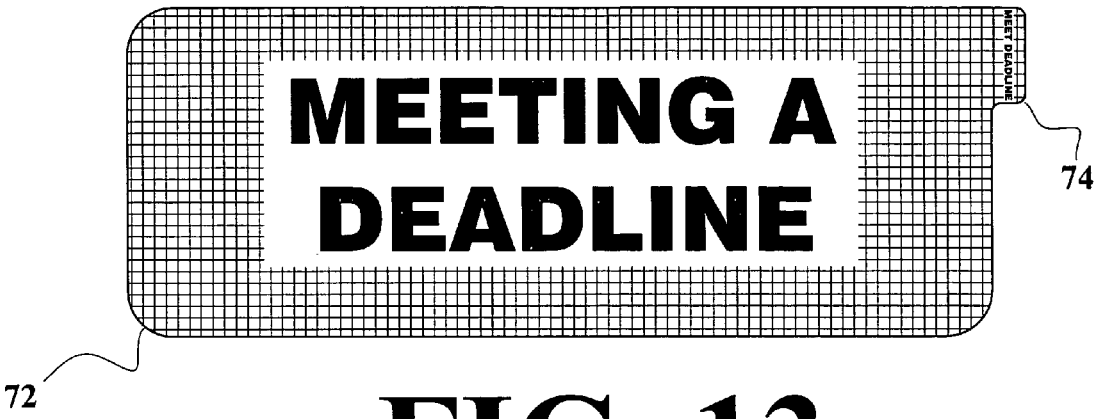
FIG. 13 is a front elevational view of a message card that may be inserted into the middle section of the sign, lined to indicate that its preferred color is yellow.

FIG. 13 is a front elevational view of a message card that may be inserted into the middle section of the sign, lined to indicate that its preferred color is yellow. It has the phrase "MEETING A DEADLINE" on its main body, which is abbreviated as "MEET DEADLINE" on its tab.

Figure 14:
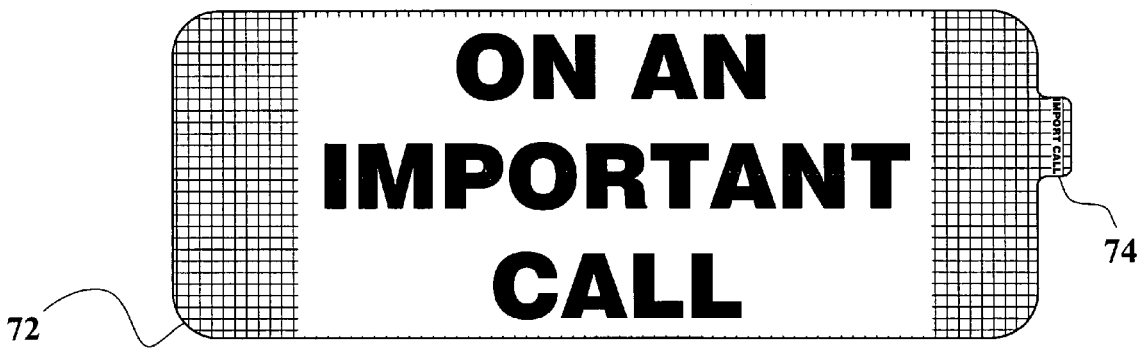
FIG. 14 is a front elevational view of a message card that may be inserted into the middle section of the sign, lined to indicate that its preferred color is yellow.

FIG. 14 is a front elevational view of a message card that may be inserted into the middle section of the sign, lined to indicate that its preferred color is yellow. It has the phrase "ON AN IMPORTANT CALL" on its main body, which is abbreviated as "IMPORT CALL" on its tab.

Figure 15:
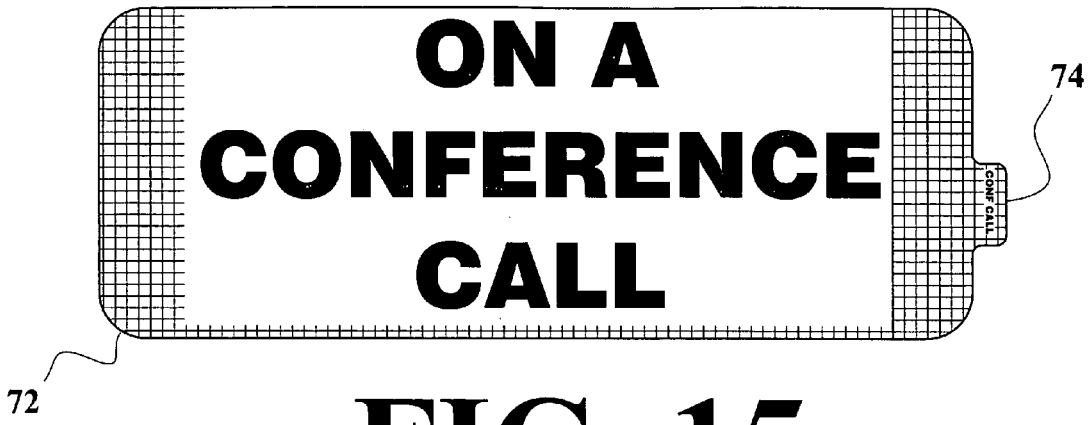
FIG. 15 is a front elevational view of a message card that may be inserted into the middle section of the sign, lined to indicate that its preferred color is yellow.

FIG. 15 is a front elevational view of a message card that may be inserted into the middle section of the sign, lined to indicate that its preferred color is yellow. It has the phrase "ON A CONFERENCE CALL" on its main body, which is abbreviated as "CONF CALL" on its tab.

Figure 16:
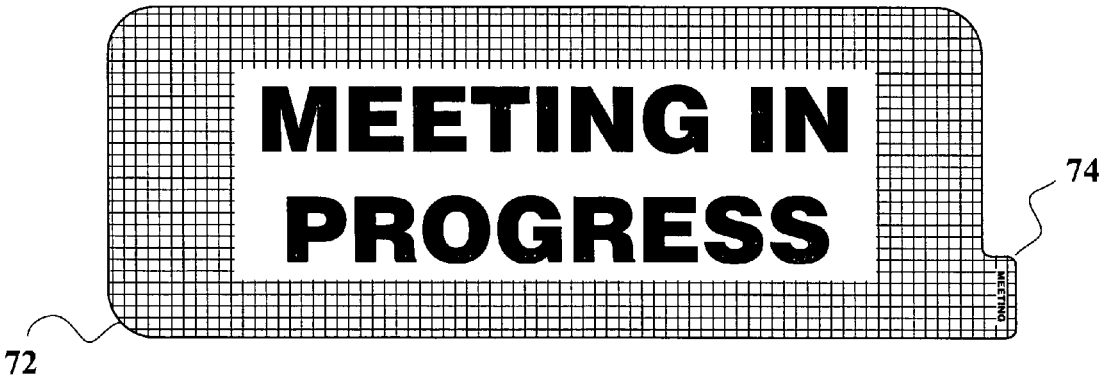
FIG. 16 is a front elevational view of a message card that may be inserted into the middle section of the sign, lined to indicate that its preferred color is yellow.

FIG. 16 is a front elevational view of a message card that may be inserted into the middle section of the sign, lined to indicate that its preferred color is yellow. It has the phrase "MEETING IN PROGRESS" on its main body, which is abbreviated as "MEETING" on its tab.

Figure 17:
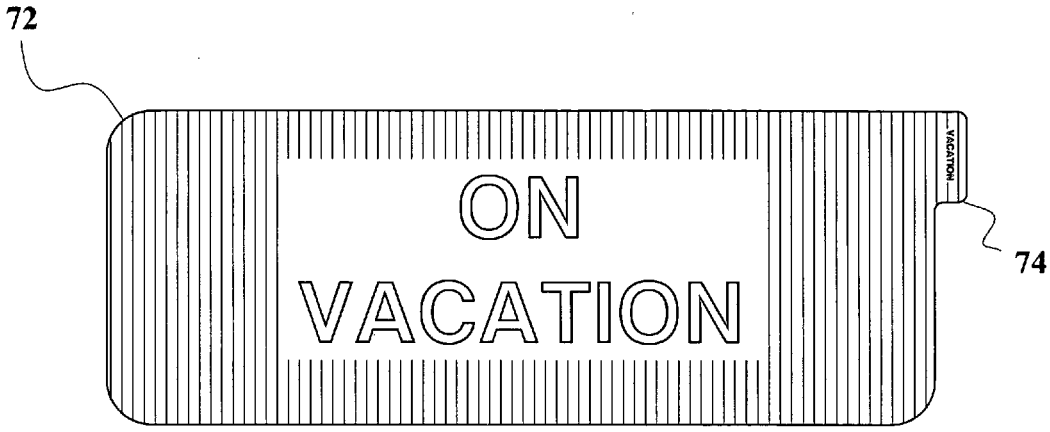
FIG. 17 is a front elevational view of a message card that may be inserted into the middle section of the sign, lined to indicate that its preferred color is red.

FIG. 17 is a front elevational view of a message card that may be inserted into the middle section of the sign, lined to indicate that its preferred color is red. It has the phrase "ON VACATION" on its main body, which is abbreviated as "VACATION" on its tab.

Figure 18:
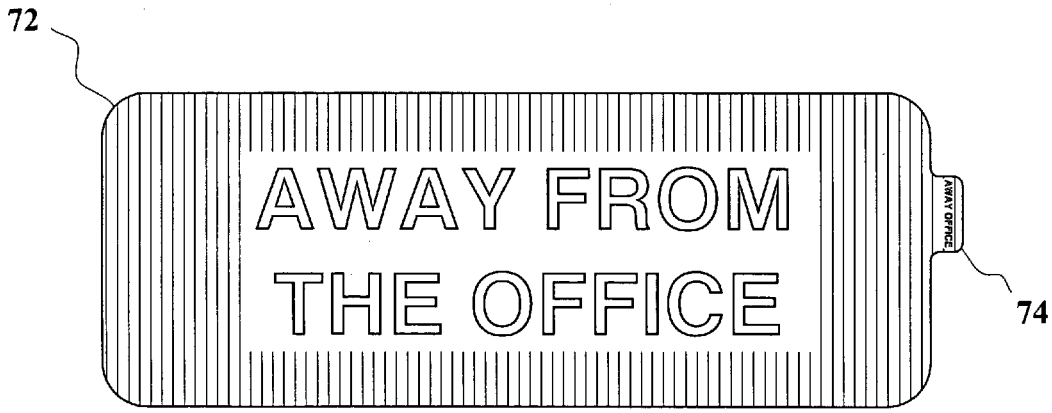
FIG. 18 is a front elevational view of a message card that may be inserted into the middle section of the sign, lined to indicate that its preferred color is red.

FIG. 18 is a front elevational view of a message card that may be inserted into the middle section of the sign, lined to indicate that its preferred color is red. It has the phrase "AWAY FROM THE OFFICE" on its main body, which is abbreviated as "AWAY OFFICE" on its tab.

Figure 19:
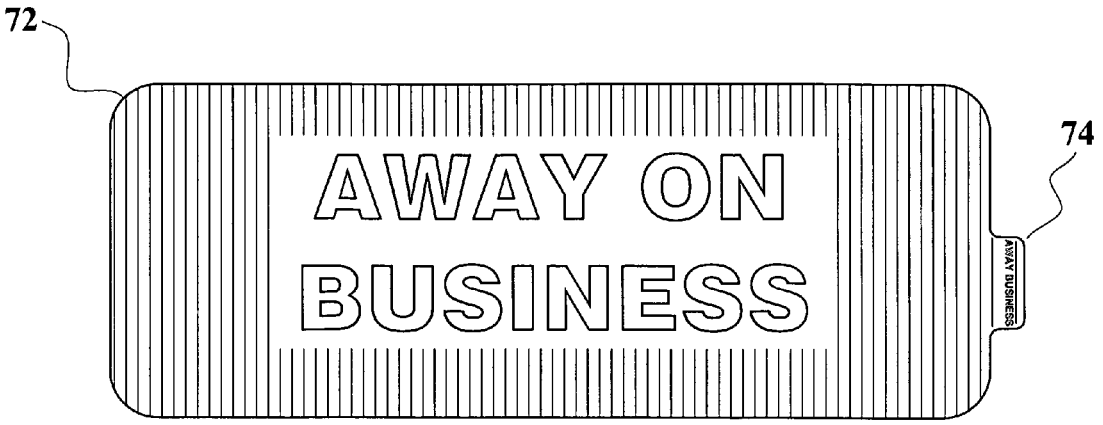
FIG. 19 is a front elevational view of a message card that may be inserted into the middle section of the sign, lined to indicate that its preferred color is red.

FIG. 19 is a front elevational view of a message card that may be inserted into the middle section of the sign, lined to indicate that its preferred color is red. It has the phrase "AWAY ON BUSINESS" on its main body, which is abbreviated as "AWAY BUSINSS" on its tab.

Figure 20:
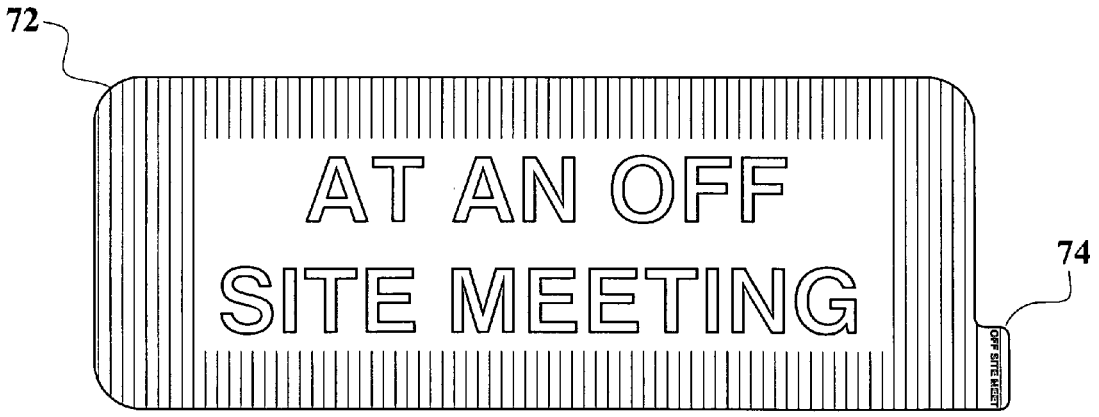
FIG. 20 is a front elevational view of a message card that may be inserted into the middle section of the sign, lined to indicate that its preferred color is red.

FIG. 20 is a front elevational view of a message card that may be inserted into the middle section of the sign, lined to indicate that its preferred color is red. It has the phrase "AT AN OFF SITE MEETING" on its main body, which is abbreviated as "OFF SITE MEETING" on its tab.

Alternatively, the board may be retained on a wall, door or other surface by strips of hook and loop fasteners, glue, nails, screws, or any other suitable means. Besides the message cards shown in the drawings, cards having any suitable messages may be used to indicate the occupant's availability and the reasons therefor. Indicia may be placed on the front frame, such as a trademark, or the name of the occupant of the cubicle or office. The message cards are preferably made of plastic. The front frame and rear panel are preferably made of wood or plastic. The color of the front frame is preferably blue. The horizontal and vertical members of the front frame are preferably rounded in front.

The invention also includes a method of using the above-described apparatus by the occupant of a work enclosure to silently communicate with colleagues, superiors, subordinates, customers, or other prospective visitors, comprising the steps of:

1. Attaching the board to an exterior surface of the work enclosure.

2. Inserting a message card in the top section to indicate whether or not the occupant is available.

3. Inserting a message card in the middle section to indicate why.

4. Inscribing a further explanation in the bottom section.

The functions of the sections may be reversed.

I claim:

1. A sign, comprising:

a single frame having a plurality of sections;

a plurality of message cards, each message card having a tab extending from a side of the message card;

a slot in at least one section in which one of the message cards may be retained and displayed; and at least one slot in which message cards may be retained and hidden from view, except for their tabs that extend outside the slot;

wherein at least one section has an area suitable as a writing surface;

wherein each message card has a message on a front surface and indicia on its tab that repeats or summarizes the message, with the exception of at least one blank message card that has a front surface with an area suitable as a writing surface;

wherein the message cards have two sizes, with a larger size having a greater height than a smaller size, and there are two slots in which the message cards may be displayed, with a larger slot for the larger message cards, and a smaller slot for the smaller message cards; and wherein the message cards are color coded, with larger message cards of a first color having messages that are suitable for display with the smaller message card of the same first color, and larger message cards of a second color having messages that are suitable for display with the smaller message card of the same second color.

2. The sign according to claim 1, including a holder for a writing implement on a top edge of the frame.

3. The sign according to claim 2, including at least one bracket that can be removably attached to a rear surface of the sign.

4. The sign according to claim 3, wherein:

the bracket has a first L-shaped portion, with a first section having holes by which it may be retained at a plurality of heights by fasteners extending from the rear surface of the sign, and a second section perpendicular to the first section, the second section having a flexible tongue with a knob on an upper surface of the tongue; and the bracket has a second L-shaped portion, with a first section that is parallel to the first section of the first L-shaped portion when they are joined together, and a second section perpendicular to the first section, within which the second section of the first L-shaped portion may be inserted, the second section of the second L-shaped portion having a hole in an upper surface suitably configured to retain the knob of the tongue in one of a plurality of fixed positions, but allowing movement between portions of the hole when the tongue is depressed, to adjust the distance between the first sections of the L-shaped portions and the width of the bracket.

5. The sign according to claim 4, wherein there are two of the brackets.

6. The sign according to claim 5, wherein the sign has three sections, including a top section in which the smaller message cards may be displayed, a middle section in which the larger message cards may be displayed, and a bottom section having the area suitable for a writing surface.

7. The sign according to claim 6, wherein the frame, each section of the frame, and the message cards are rectangular with rounded corners.

8. The sign according to claim 7, wherein the larger and smaller message cards have the same width.

9. The sign according to claim 8, wherein each section of the frame has a rear portion containing one of the slots in which message cards are retained and hidden from view.

10. The sign according to claim 9, wherein the slot contained in the rear portion of the top section is suitably dimensioned and configured to retain the smaller message cards, and the slots contained in the rear portions of the middle and bottom sections are suitably dimensioned and configured to retain the larger message cards.

11. The sign according to claim 10, wherein there is only one blank message card, and it is one of the message cards having the larger size.

12. The sign according to claim 11, wherein there are three of the smaller message cards, including a first smaller message card of the first color with the word "BUSY" on its front surface and tab, a second smaller message card of the second color with the word "OUT" on its front surface and tab, and a third smaller message card of a third color with the word "AVAILABLE" on its front surface and tab.

13. The sign according to claim 12, wherein there are:

four of the larger message cards of the first color, having on their front surfaces the messages "MEETING A DEADLINE", "ON AN IMPORTANT CALL", "ON A CONFERENCE CALL", and "MEETING IN PROGRESS", and abbreviated versions of these messages on their tabs;

four of the larger message cards of the second color, having on their front surfaces the messages "ON VACATION", "AWAY FROM THE OFFICE", "AWAY ON BUSINESS", and "AT AN OFF SITE MEETING", and abbreviated versions of these messages on their tabs; and one of the larger message cards of the third color, having the word "WELCOME" on its front surface and tab.

14. The sign according to claim 13, wherein the first color is yellow, the second color is red, and the third color is green.

* * * * *